US010927624B2

(12) United States Patent
Bauer

(10) Patent No.: US 10,927,624 B2
(45) Date of Patent: Feb. 23, 2021

(54) ROTARY DRILLING TOOL AND METHOD FOR PRODUCING A BORE IN THE GROUND

(71) Applicant: BAUER Maschinen GmbH, Schrobenhausen (DE)

(72) Inventor: Sebastian Bauer, Schrobenhausen (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 70 days.

(21) Appl. No.: 16/466,613

(22) PCT Filed: Oct. 12, 2017

(86) PCT No.: PCT/EP2017/076019
§ 371 (c)(1),
(2) Date: Jun. 4, 2019

(87) PCT Pub. No.: WO2018/103919
PCT Pub. Date: Jun. 14, 2018

(65) Prior Publication Data

US 2019/0390519 A1 Dec. 26, 2019

(30) Foreign Application Priority Data

Dec. 7, 2016 (EP) ..... 16202683

(51) Int. Cl.
*E21B 21/16* (2006.01)
*E21B 3/02* (2006.01)
(Continued)

(52) U.S. Cl.
CPC ..... *E21B 21/16* (2013.01); *E21B 3/02* (2013.01); *E21B 10/06* (2013.01); *E21B 21/015* (2013.01);
(Continued)

(58) Field of Classification Search
None
See application file for complete search history.

(56) References Cited

U.S. PATENT DOCUMENTS 3,901,332 A 8/1975 Ebner et al.
4,526,242 A 7/1985 Mathieu et al.
(Continued)

FOREIGN PATENT DOCUMENTS

CA 2 356 570 A1 3/2003
DE 20 2015 102 848 U1 6/2015
(Continued)

OTHER PUBLICATIONS

International Search Report issued in PCT/EP2017/076019; dated Dec. 22, 2017.
(Continued)

*Primary Examiner* — Tara Schimpf
(74) *Attorney, Agent, or Firm* — Studebaker & Brackett PC

(57) ABSTRACT

The invention relates to a drilling tool and a method for producing a bore in the ground, in which method ground material is carried away by a removal device on the underside of a main body of the drilling tool, flushing air is supplied by a feeding device into the bore, which is filled with drilling fluid, in the area of the removal device and ground material carried away by means of the flushing air is transported away through a discharge line. According to the invention, the ground material is transported to a receiving area in an upper section of the main body. A collecting hood is provided above the receiving area, which closes off the receiving area at the top, forming an air collecting space in which air collects. An outlet valve by means of which air is discharged from the air collecting space is arranged on the collecting hood.

11 Claims, 3 Drawing Sheets

Figure 1:
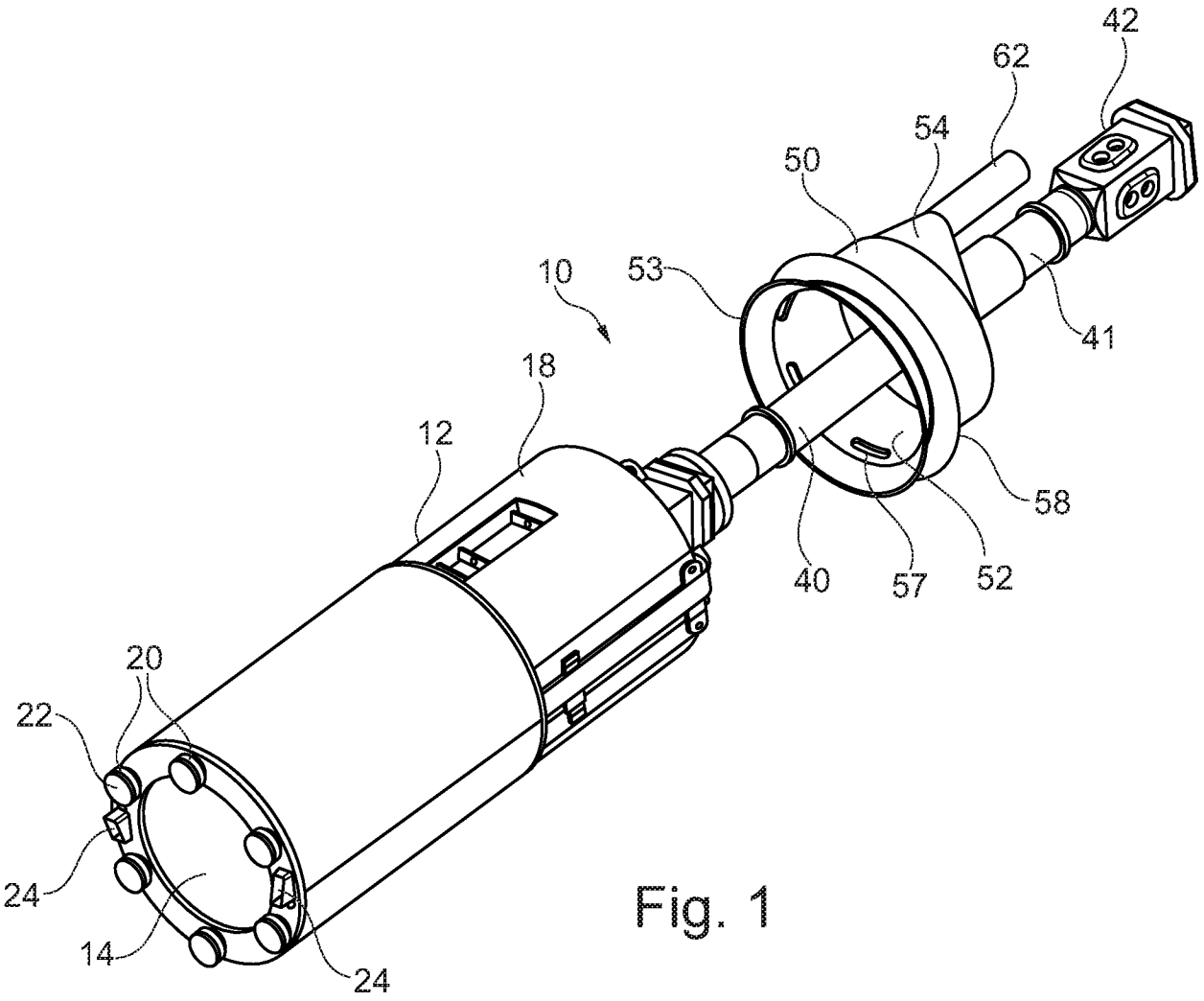

(51) Int. Cl.

| | |
|---|---|
| ***E21B 10/06*** | (2006.01) |
| ***E21B 21/015*** | (2006.01) |
| *E21B 7/00* | (2006.01) |
| *E21B 10/48* | (2006.01) |
| *E21B 21/01* | (2006.01) |

(52) U.S. Cl.
CPC ..... *E21B 7/003* (2013.01); *E21B 10/485* (2013.01); *E21B 21/011* (2020.05)

(56) References Cited

U.S. PATENT DOCUMENTS

| | | | | |
|---|---|---|---|---|
| 2001/0006120 | A1* | 7/2001 | Miyamoto | E21B 4/14 175/61 |
| 2010/0187017 | A1* | 7/2010 | Lyon | E21B 21/16 175/296 |

FOREIGN PATENT DOCUMENTS

| | | | |
|---|---|---|---|
| EP | 2 592 214 | A1 | 5/2013 |
| EP | 2 886 789 | A1 | 6/2015 |
| GB | 735 969 | A | 8/1955 |

OTHER PUBLICATIONS

Notification of Transmittal of Translation of the International Preliminary Report on Patentability and Translation of Written Opinion of the International Searching Authority issued in PCT/EP2017/076019; dated Jun. 20, 2019.

* cited by examiner

ROTARY DRILLING TOOL AND METHOD FOR PRODUCING A BORE IN THE GROUND

The invention relates to a rotary drilling tool for producing a bore in the ground with a base body, a removal means arranged on an underside of the base body for removing ground material, a supply means for supplying flushing air into the region of the removal means and a discharge line for discharging removed ground material and drilling suspension, which can be conveyed by means of the flushing air into the receiving region, in accordance with the preamble of claim 1.

The invention further relates to a method for producing a bore with a rotary drilling tool, in which ground material is removed with a removal means on an underside of a base body of the rotary drilling tool, by means of a supply means flushing air is supplied to the bore filled with drilling suspension into the region of the removal means and by means of the flushing air removed ground material is conveyed away via a discharge line, in accordance with the preamble of claim 11.

A generic rotary drilling tool is known from EP 2 592 214 A1. By means of flushing air the removed ground material is conveyed away from the borehole via a discharge line. In the case of great drilling depths there is a high demand for pressurized air as flushing air.

A core drilling tool having internal and external flights for producing a flushing flow can be taken from DE 20 02015 102 848 U1.

In such a rotary drilling tool it is generally advantageous that the flushing air can be used in two ways. First of all, the flushing air serves for flushing out the removal means, in particular roller bits during the removal of hard rock. For the functioning of roller bits it is essential that these can have a direct impact on the in-situ ground. At the same time, the flushing air serves as a conveying medium to convey the removed ground material in the upward direction to the receiving space on the rotary drilling tool.

In the known rotary drilling tools and methods the flushing air continues to flow upwards through the drilling suspension in the borehole even if the ground material gradually settles in the receiving space on the rotary drilling tool. The upward-flowing air can loosen ground material from the wall of the bore and destabilize it.

The invention is based on the object to provide a rotary drilling tool and a method for producing a bore in the ground, with which a bore can be produced efficiently on application of flushing air.

In accordance with the invention the object is achieved on the one hand by a drilling tool having the features of claim 1 and on the other hand by a method having the features of claim 11. Preferred embodiments of the invention are stated in the respective dependent claims.

The rotary drilling tool according to the invention is characterized in that the removed ground material is conveyed to a receiving region which is arranged in an upper section of the base body, in that above the receiving region a collecting hood is provided which closes off an air accumulation space above the receiving region in the upward direction, and in that on the collecting hood a drain valve is arranged which is designed for the targeted discharge of air from the air accumulation space.

By means of the introduced flushing air the removed ground material is conveyed away from the borehole bottom and can settle in an upper region of the rotary drilling tool in a receiving space. On reaching a certain degree of filling the rotary drilling tool is withdrawn from the borehole and emptied on the ground surface. Afterwards, the drilling process can be continued.

The invention is based on the finding that flushing air flowing freely upwards can also carry away ground material from the wall of the bore in the upward direction. As a result, the bore wall may become unstable. Especially when making use of a bentonite solution a bentonite film develops on the bore wall. This bentonite film has a stabilizing effect on the bore wall. Through upward-flowing flushing air this stabilizing bentonite film can be damaged in particular and thus the stability of the bore as a whole can be affected.

Through the design of the rotary drilling tool in accordance with the invention this problem is solved comprehensively. The upward-flowing flushing air is collected above the receiving region by way of a collecting hood with an air accumulation space. Hence, flushing air is prevented from flowing further upwards along the borehole wall.

According to a further aspect of the invention provision is made on the collecting hood for a drain valve, with which air can be discharged in a targeted manner from the air accumulation space at certain points in time or under certain circumstances.

Another advantage of the invention can be seen in the fact that the air thus accumulated and discharged can generally be reused and redirected as flushing air into the bore. This flushing air circulation is especially environmentally friendly. On the outer circumference of the collecting hood an annular sealing, more particularly an inflatable annular sealing, can be provided to seal off a gap towards the borehole wall.

A preferred embodiment of the invention resides in the fact that the drain valve is connected to an exhaust air line, with which air can be discharged from the bore to the ground surface. The exhaust air line can be a hose or a tube. Through this the collected air is reliably discharged in the upward direction without making contact with the borehole wall.

Basically, the drain valve can be actuated by an operator, e.g. in a drilling apparatus. According to a further development of the invention it is advantageous that a control means for the controlled actuation of the drain valve is provided. The control means can have sensors, such as filling level or pressure sensors, to determine a suitable point in time or condition for the discharge of air. By preference, the control means has a sensor which, on reaching a predetermined filling level in the collecting hood, actuates the control means to open the drain valve. On reaching a predetermined condition a discharge of air can then take place automatically by the control means.

According to an embodiment variant it is particularly expedient for the control means to have a float gauge that floats on the boundary surface between drilling suspension and flushing air under the collecting hood, wherein when a predetermined filling level is reached in the collecting hood the control means can be actuated by the float gauge to open the drain valve. On progressive operation an increasing amount of air accumulates under the collecting hood. As a result, the float gauge, which floats on the boundary surface between the drilling suspension and the air accumulation space, is lowered gradually. When the float gauge reaches a lower threshold level the control means is actuated, whereby the drain valve is opened. The opening of the drain valve can take place until such time as the float gauge reaches an upper limit value or an upper filling level again. The drain valve can then be closed again by the control means.

Moreover, the rotary drilling tool according to the invention is developed further in that a supply line for flushing air is provided which leads from outside the borehole to the underside of the base body with the removal means. In particular, from outside the borehole flushing air can be supplied continuously by means of a compressor into the borehole to the removal means. The supply line can have several outlet openings on the annular removal means in order to convey ground material as extensively as possible from the borehole bottom.

Basically, the removal means can be of any chosen design. According to an embodiment variant of the invention it is especially preferred that the removal means has at least one rotatably supported roller bit and/or at least one stationary round shank bit and/or at least one stationary removal tooth.

Moreover, a preferred further development of the invention resides in the fact that several rotatably supported roller bits and/or stationary round shank bits and/or stationary removal teeth are mounted on the underside of the base body. By combining different removal elements a particularly good drilling progress can even be achieved in the case of varying ground conditions.

Provision can also be made for active removal tools, preferably axially movable hammers for stripping the ground material. Through the supply of energy, such as pressurized air or a hydraulic fluid, these exert an axial percussive movement onto the in-situ hard ground material.

Another expedient embodiment of the invention resides in the fact that a connecting means for connecting the rotary drilling tool to a drill drive instrument is arranged above the collecting hood. The connecting means can in particular be designed as a Kelly box, with which a drill rod, in particular a Kelly bar for transmitting a torque and an advance force, can be fixed in a releasable and force-locked manner. The connecting means can be arranged centrally on the upper side of the collecting hood. The rotary drilling tool can thereby be used on customary drilling apparatuses. Provision can be made for a central shaft, at the upper end of which the connecting means is fixed for the torque transmission. By preference, the collecting hood is supported in an axially adjustable manner on the central shaft.

According to a further development of the invention it is advantageous for the rotary drilling tool to be a core drill which is designed for producing a drill core and for receiving the drill core in the interior of the tubular base body. In this connection it is expedient for the ground material to be stripped annularly by the removal means which has an annular configuration of cutting instruments or removal elements. Through the annular removal of solid ground material a cylindrical drill core is thus produced in an especially efficient way in the borehole.

Preferably, a drill core is retained in a force-locked manner in the interior of the base body by a core catcher means and is subsequently separated from the borehole bottom through force application. The drill core can be conveyed to a foundation ground surface by a separate tool or together with the rotary drilling tool.

The invention furthermore comprises a drilling apparatus for producing a bore in the ground with a mast and a drill drive for driving a rotary drilling tool in a rotatable manner, wherein the rotary drilling tool is designed as set out above. By connecting the rotary drilling tool according to the invention with a drill drive, which is mounted on a mast of a drilling apparatus and drives the rotary drilling tool in a rotating manner, it is possible to produce boreholes with such a drilling apparatus in a particularly efficient manner in the foundation ground and in all ground materials in-situ therein and basically in all technically realizable depths.

With regard to the method the object referred to at the beginning is achieved in accordance with the invention in that the removed ground material is conveyed to a receiving region which is arranged in an upper section of the base body, in that above the receiving region a collecting hood is provided which closes off the receiving region in the upward direction by forming an air accumulation space, in which air accumulates, and in that on the collecting hood a drain valve is arranged, with which air is discharged from the accumulation space.

By way of the method according to the invention the advantages set out beforehand can be achieved. By preference, the method is carried out using the previously described rotary drilling tool which has a collecting hood with an air accumulation space above a receiving space for the removed ground material. The collecting hood is preferably of conical design or in the shape of a spherical cap, with the drain valve being arranged on an upper tip for the discharge of air.

A preferred embodiment variant of the method according to the invention resides in the fact that the drain valve is opened and closed by being controlled by a control means. An automatic control ensures that air is discharged reliably from the rotary drilling tool and that predetermined threshold values of the filling level inside the rotary drilling tool are not exceeded or underrun at any time.

Figure 2:
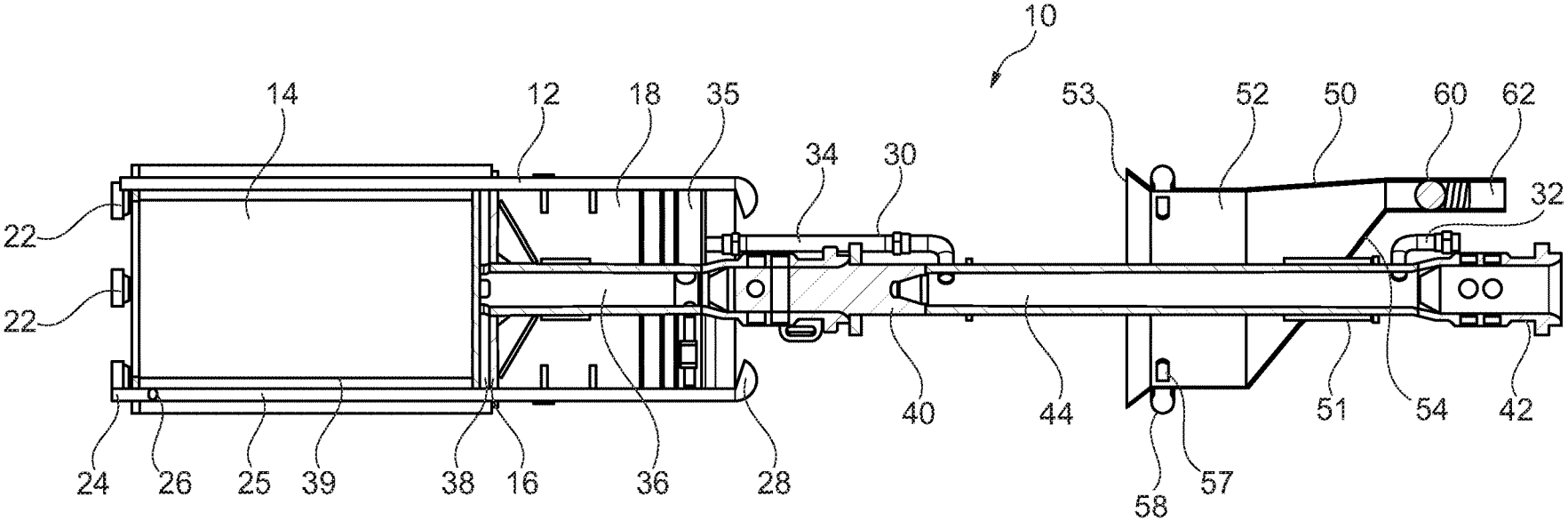
Figure 3:
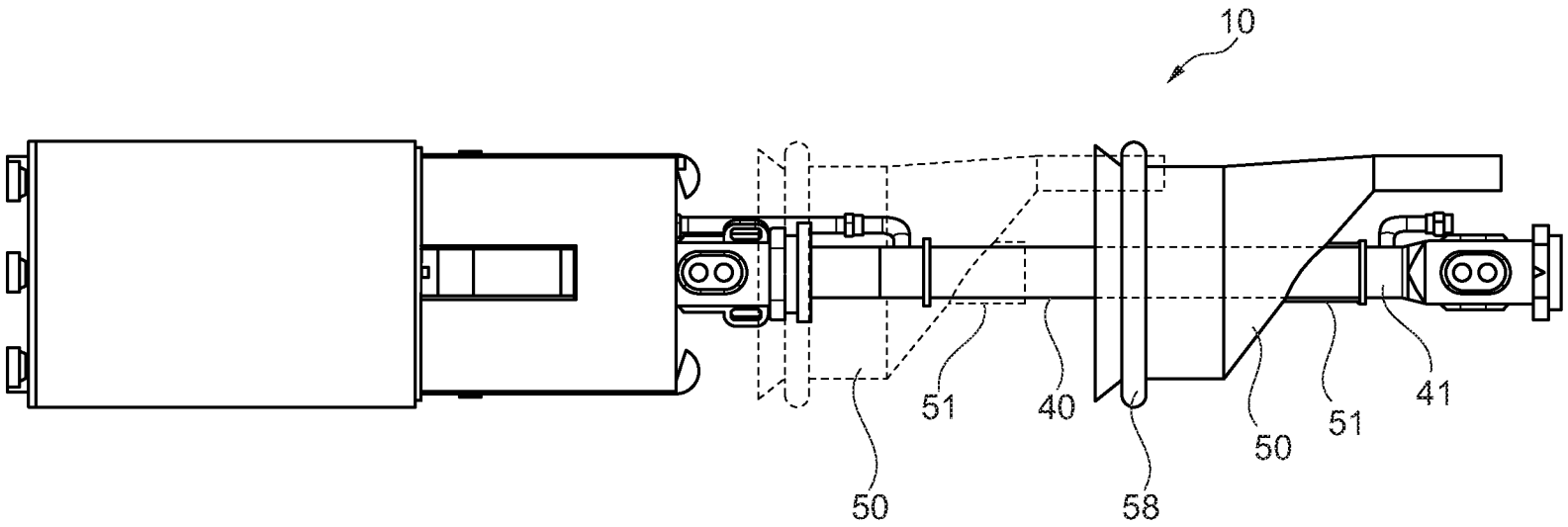

The invention is described further hereinafter by way of a preferred embodiment illustrated schematically in the accompanying drawings, wherein show:

FIG. 1 a perspective view of a rotary drilling tool according to the invention;

FIG. 2 a cross-sectional view of the rotary drilling tool of FIG. 1; and FIG. 3 a side view of the rotary drilling tool of FIGS. 1 and 2 with different positions of the collecting hood.

A rotary drilling tool 10 according to the invention for producing a bore in the ground is explained hereinafter in conjunction with FIGS. 1 and 2. The rotary drilling tool 10 has a base body 12 with a removal means 20 on the underside of the base body 12. The cylindrical base body 12 is of tubular design with a central drill core receiving part 14. The removal means 20 is of annular design with several disk-shaped hammers 22. The hammers 22 are designed as so-called pneumatic hammers that are moved back and forth axially through the feeding of pressurized air, whereby percussive impulses are exerted onto the in-situ ground in order to remove hard ground material.

On an upper side of the base body 12 the rotary drilling tool 10 has a central drill rod 40 with an upper connecting means 42 that is designed as a so-called Kelly box. This serves for the attachment of further drill rod elements to transmit a torque from a non-depicted drilling apparatus to the rotary drilling tool 10.

Via a supply means 30 pressurized air is fed from the drilling apparatus to the base body 12. Via an upper supply line 32 pressurized air is fed into an inner line duct 44 in the drill rod 40. Via an intermediate line 34 the inner line duct 44 in the drill rod 40 is line-connected to a transverse duct 35 in the base body 12. From the transverse duct 35 the pressurized air can be directed through a central tube 36 on the base body 12 to a transversely running distribution line 38 and subsequently to vertically running distribution lines 39 that lead to the drive units of the hammers 22.

The pressurized air spent during actuation of the hammers 22 is directed into the bore filled with suspension so as to convey the stripped ground material away. The pressure fluid emerging at the lower end regions of the hammers 22 directs the removed ground material to discharge openings 24 on the underside of the base body 12. From the discharge openings 24 the removed ground material, together with the emerging flushing air and sucked-in drilling suspension, can flow vertically upwards through a discharge line 25 to the upper end of the cylindrical base body 12. To assist the flow and a suction effect pressurized air can flow via one or several connecting ducts 26 directly from the vertical distribution line 39 over into the vertical discharge line 25.

On the upper end of the discharge lines 25 bends 28 with downward-directed outlet openings are provided so that the discharged ground material is conveyed in a downward-directed manner into a cylindrical receiving region 18 on the base body 12. In this receiving region 18 the solid constituents of the discharged suspension can sediment downwards onto an intermediate floor 16 of the rotary drilling tool 10. Conversely, air emerging from the bends 28 can flow upwards along the drilling axis.

According to a finding of the invention the air flowing freely upwards can lead to a destabilization of the borehole wall of the produced bore. To counteract this, in the rotary drilling tool 10 according to the invention a collecting hood 50 with a sliding sleeve 52 is supported in a vertically displaceable and rotatable manner along a cylindrical guide section 41 of the drill rod 40. The collecting hood 50 has a circular entrance region 53, the external diameter of which substantially corresponds to the diameter of the bore. The collecting hood 50 encloses an air accumulation space 52, in which upward-flowing air is received. An upper region of the collecting hood 50 is provided with a tapering 54 that merges into an exhaust air line 62 with a drain valve 60. The collecting hood 50 is supported in a rotatable manner relative to the base body 12. Alternatively, it can also be connected in a torque-proof manner to the base body 12.

Initially, the drain valve 60 is closed until a sufficient amount of air has accumulated in the air accumulation space 52 of the collecting hood 50. By means of a non-depicted control the drain valve 60 is opened at certain points in time or when a certain air pressure or amount of air is reached in the collecting hood 50 so that air can flow from the bore upwards in a controlled manner through the exhaust air line 62.

To reliably prevent the leakage of air from around the collecting hood 50 an inflatable annular sealing 58 is preferably provided on an external circumference of a cylindrical section of the collecting hood 50. The inflatable annular sealing 58 is supplied with pressurized air via a feed 57 which is designed in the illustrated embodiment as simple through-openings to the air accumulation space 52. A pressure increase in the air accumulation space 52 results in a corresponding tight inflation of the annular sealing 58. Alternatively or additionally, a feeding of pressurized air can also be provided from outside so that the inflatable annular sealing 58 can be actuated at any point in time by means of a control.

Basically, by way of the annular sealing 58 the entire lower region of the bore underneath the collecting hood 50 can serve as an air accumulation space 52. To enlarge this air accumulation space 52 the collecting hood 50 can be adjusted vertically along the guide section 41 of the drill rod 40, as illustrated graphically in FIG. 3. Adjustment can take place by a non-depicted adjustment means, e.g. by means of an adjustment cylinder, or automatically during operation by the rising and accumulated air in the collecting hood 50.

The invention claimed is:

1. A rotary drilling tool for producing a bore in the ground with a base body, a removal means arranged on an underside of the base body for removing ground material, a supply means for supplying flushing air into the region of the removal means and a discharge line for discharging removed ground material and drilling suspension, which can be conveyed away by the flushing air, wherein in an upper section of the base body a receiving region for receiving the removed ground material from the discharge line is provided, in that above the receiving region a collecting hood is arranged which closes off an air accumulation space above the receiving region in the upward direction, and in that on the collecting hood a drain valve is arranged which is designed for the targeted discharge of air from the air accumulation space.

2. The rotary drilling tool according to claim 1, wherein the drain valve is connected to an exhaust air line, with which air can be discharged from the bore to the ground surface.

3. The rotary drilling tool according to claim 1, wherein a controller for the controlled actuation of the drain valve is provided.

4. The rotary drilling tool according to claim 3, wherein the controller has a sensor which, on reaching a predetermined filling level in the collecting hood, actuates the control means to open the drain valve.

5. The rotary drilling tool according to claim 1, wherein the supply means includes a supply line for flushing air, the supply line leading from outside the borehole to the underside of the base body with the removal means.

6. The rotary drilling tool according to claim 1, wherein the removal means has axially movable hammers.

7. The rotary drilling tool according to claim 1, wherein a connecting means for connecting the rotary drilling tool is arranged above the collecting hood.

8. The rotary drilling tool according to claim 1, designed for producing a drill core and for receiving the drill core in the interior of the tubular base body.

9. A drilling apparatus for producing a bore in the ground, the drilling apparatus being provided with the rotary drilling tool according to claim 1.

10. A method for producing a bore in the ground with the rotary drilling tool, in particular according to claim 1, wherein ground material is removed with the removal means on an underside of the base body of the rotary drilling tool, flushing air is supplied, via the supply means, to the bore filled with drilling suspension into the region of the removal means and removed ground material is conveyed away via a discharge line via the flushing air, wherein the removed ground material is conveyed to the receiving region which is arranged in the upper section of the base body, above the receiving region, the collecting hood is provided which closes off the receiving region in the upward direction by forming the air accumulation space, in which air accumulates, and on the collecting hood, the drain valve is arranged, with which air is discharged from the air accumulation space.

11. The method according to claim 10, wherein the drain valve is opened and closed by being controlled by a controller.

* * * * *